US010577205B2

(12) United States Patent
Kokubo

(10) Patent No.: US 10,577,205 B2
(45) Date of Patent: Mar. 3, 2020

(54) SHEET CONVEYING APPARATUS AND IMAGE FORMING APPARATUS

(71) Applicant: CANON KABUSHIKI KAISHA, Tokyo (JP)

(72) Inventor: Hiroshi Kokubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/954,988

(22) Filed: Apr. 17, 2018

(65) Prior Publication Data

US 2018/0305153 A1 Oct. 25, 2018

(30) Foreign Application Priority Data

Apr. 24, 2017 (JP) ..... 2017-085129

(51) Int. Cl.

| | |
|---|---|
| ***B65H 85/00*** | (2006.01) |
| ***B65H 5/26*** | (2006.01) |
| ***B65H 5/06*** | (2006.01) |
| ***B65H 7/00*** | (2006.01) |
| ***B65H 5/38*** | (2006.01) |

(52) U.S. Cl.

CPC ..... *B65H 5/26* (2013.01); *B65H 5/062* (2013.01); *B65H 5/38* (2013.01); *B65H 7/00* (2013.01); *B65H 85/00* (2013.01); *B65H 2301/33312* (2013.01); *B65H 2301/51212* (2013.01); *B65H 2511/11* (2013.01); *B65H 2513/108* (2013.01); *B65H 2515/81* (2013.01); *B65H 2801/06* (2013.01)

(58) Field of Classification Search

CPC . B65H 85/00; B65H 5/38; B65H 5/36; B65H 2301/33312; B65H 2301/51212

See application file for complete search history.

(56) References Cited

U.S. PATENT DOCUMENTS

| | | | | |
|---|---|---|---|---|
| 6,419,222 | B1 * | 7/2002 | Morrison | B65H 15/00 271/186 |
| 6,626,428 | B2 * | 9/2003 | Soga | B65H 29/14 271/182 |
| 2010/0239296 | A1 * | 9/2010 | Kimura | G03G 15/234 399/68 |
| 2010/0296856 | A1 * | 11/2010 | Moriyama | B41J 3/60 400/642 |

FOREIGN PATENT DOCUMENTS

| | | |
|---|---|---|
| JP | 2015-025911 A | 2/2015 |

* cited by examiner

*Primary Examiner* — Thomas A Morrison
(74) *Attorney, Agent, or Firm* — Venable LLP

(57) ABSTRACT

Disclosed is a sheet conveying apparatus, including: a conveying member configured to convey a sheet; a plurality of changing portions successively provided downstream of the conveying member in a conveying direction of the sheet, the plurality of changing portions being configured to change the conveying direction of the sheet conveyed by the conveying member by curving the sheet; and a control portion configured to control a conveying speed of the sheet. The control portion controls a conveying speed of the sheet such that V1<V2 where V1 indicates a conveying speed of a sheet conveyed by the conveying member, a leading end of which sheet passes through a specific changing portion among the plurality of changing portions, and V2 indicates a conveying speed of a sheet conveyed without passing through the specific changing portion.

14 Claims, 11 Drawing Sheets

FIG. 9

| CONVEYING SPEED mm/s | OCCURRENCE OF BUCKLING |
|---|---|
| 300 | ABSENCE |
| 400 | ABSENCE |
| 500 | ABSENCE |
| 600 | ABSENCE |
| 700 | PRESENCE |
| 800 | PRESENCE |
| 900 | PRESENCE |
| 1000 | PRESENCE |
| 1100 | PRESENCE |
| 1200 | PRESENCE |
| 1300 | PRESENCE |
| 1400 | PRESENCE |
| 1500 | PRESENCE |

SHEET CONVEYING APPARATUS AND IMAGE FORMING APPARATUS

BACKGROUND OF THE INVENTION

Field of the Invention

The present invention relates to a sheet conveying apparatus used for a printer, a digital multifunction imaging apparatus, or the like, and to an image forcing apparatus including the sheet conveying apparatus.

DESCRIPTION OF THE RELATED ART

Recently, there are many image forming apparatuses such as copying machines and laser printers, in which it is possible to form an image not only on the first surface (front surface) of a sheet but also on the second surface (back surface) by using the electro-photographic system. In such an image forming apparatus, when images are formed on both sides of a sheet, after the printing on the first surface is performed by the image forming portion for forming an image, the sheet is temporarily retreated on a retreat conveying path. After the sheet is temporarily retreated on the retreat conveying path, switching of conveying paths is performed and the sheet is turned back so that the sheet is reversed. Then, the sheet is fed to the image forming portion again and printing on the second surface of the sheet is performed.

In the above image forming apparatus, a space is needed for the retreat conveying path whose length corresponds to that of the sheet retreated on the retreat conveying path. Therefore, when a retreat conveying path is provided in an image forming apparatus, there is a problem that the image forming apparatus becomes larger as the sheet size becomes longer.

In order to deal with this problem, for example, in Japanese Laid-Open Patent Application Publication No. 2015-25911, a long sheet is bent a plurality of times at a substantially right angle to secure a retreat space even in a limited space and a retreat conveying path is provided in an option unit, thereby preventing the main body of the apparatus from becoming larger.

However, in the configuration in which a medium is bent a plurality of times at a substantially right angle on the retreat conveying path to secure a retreat space, a guide resistance applied to the leading end of the sheet conveyed at the bent portion increases. In this case, as the leading edge of the sheet is distanced away from the conveying roller provided in the retreat conveying path, the binding force against the sheet is lowered and buckling of the sheet tends to occur. In the case of a sheet with low stiffness, this tendency is more conspicuous. Particularly in the case where the sheet discharge direction by the conveying roller and the conveying direction of the leading end of the sheet after the sheet has been bent are opposite, the sheet may buckle at its leading end portion when the sheet leading end receives air resistance because the shape of the leading end of the sheet is restricted only by its own stiffness.

In addition, when a sheet with high stiffness is conveyed to the reversing portion, the guide resistance transiently increases every time the sheet passes through the bent portion, which may cause stepping-out of the conveying motor, slipping between the sheet and the roller, and skewing of the sheet.

SUMMARY OF THE INVENTION

A sheet conveying apparatus according to the present invention, comprising:

a conveying member configured to convey a sheet;

a plurality of changing portions successively provided downstream of the conveying member in a conveying direction of the sheet, the plurality of changing portions being configured to change a conveying direction of the sheet conveyed by the conveying member by curving the sheet; and a control portion configured to control a conveying speed of the sheet, wherein the control portion controls a conveying speed of the sheet such that $V1<V2$ where V1 indicates a conveying speed of a sheet conveyed by the conveying member, a leading end of which sheet passes through a specific changing portion among the plurality of changing portions, and V2 indicates a conveying speed of a sheet conveyed without passing through the specific changing portion.

Further features of the present invention will become apparent from the following description of exemplary embodiments with reference to the attached drawings.

BRIEF DESCRIPTION OF THE DRAWINGS

FIG. 9 is a table showing conditions for occurrence of buckling.

DESCRIPTION OF THE EMBODIMENTS

Next, a sheet conveying apparatus according to an embodiment of the present invention will be described with reference to the drawings, together with an image forming apparatus including the sheet conveying apparatus.

(First Embodiment) Coverall Configuration of the Image Forming Apparatus

Figure 1:
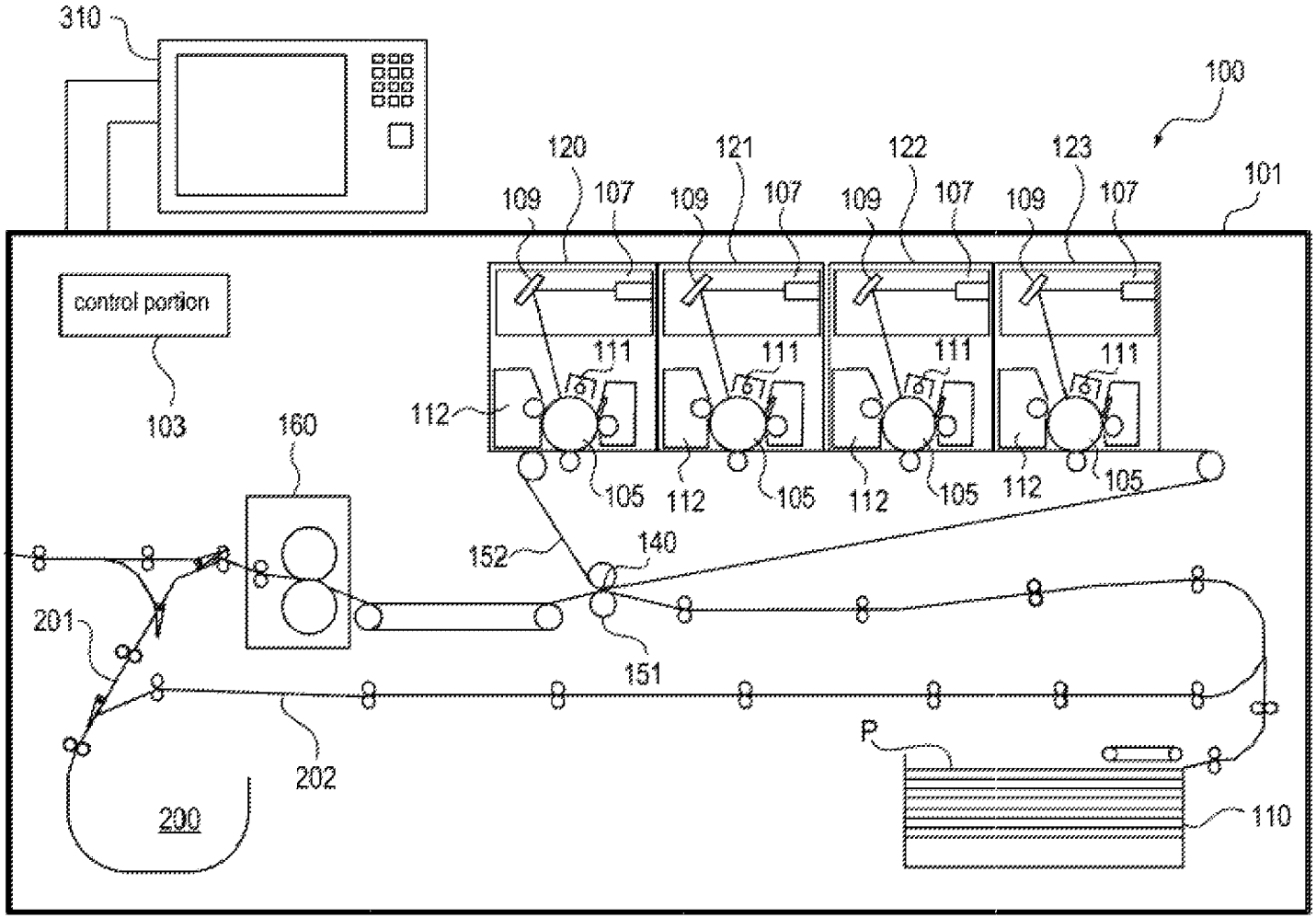
FIG. 1 is a diagram showing an overall view of an image forming apparatus.

First, the overall configuration of the image forming apparatus will be described. FIG. 1 is a cross-sectional view showing the configuration of the laser beam printer 100 (hereinafter referred to as a printer) according to this embodiment. As shown in this figure, the printer 100 has the housing 101 which includes the mechanisms for configuring the engine portion, an engine control portion for performing a control for printing processes (for example, a feeding process) by these mechanisms, and the control portion 103 which houses a printer controller.

These mechanisms for configuring the engine portion include an optical processing mechanism, a fixing processing mechanism, a feed processing mechanism for the sheet P and a conveying processing mechanism for the sheet P. The optical processing mechanism is used for forming electrostatic latent images on the photosensitive drum 105 by scanning with a laser beam, for visualizing the electrostatic latent images, for multiply transferring the latent images onto the intermediate transfer body 152 configured by an endless belt, and for further transferring the multiply transferred color image onto the sheet P. The fixing processing mechanism is used for fixing a toner image transferred onto the sheet P.

The optical processing mechanism has a laser driver for turning on and off the laser light emitted from a semiconductor laser (not shown) in the laser scanner unit 107 in accordance with the image data supplied from the control portion 103. The laser beam emitted from the semiconductor laser is swung in the scanning direction by the rotating polygon mirror. The laser beam swung in the main scanning direction is introduced to the photosensitive drum 105 via the reflection polygon mirror 109, and exposes the photosensitive drum 105 in the main scanning direction.

On the other hand, the electrostatic latent image formed on the photosensitive drum 105 by being charged by the primary charger 111 and by being scanned by laser light is visualized into a toner image by the toner supplied by the developing device 112. Then, the toner image visualized on the photosensitive drum 105 is transferred (primary transfer) onto the intermediate transfer body 152 to which a voltage having a polarity opposite to that of the toner image is applied. At the time of color image formation, the respective colors are sequentially formed on the intermediate transfer body 152 from the Y (yellow) station 120, the M (magenta) station 121, the C (cyan) station 122, and the K (black) station 123 so that a full color visible image is formed on the intermediate transfer body 152.

Next, the sheet P fed from the sheet storage 110 is conveyed and the transfer roller 151 presses the sheet P against the intermediate transfer body 152 in the transfer portion 140. At the same time, a bias whose polarity is opposite to that of the toner is applied to the transfer roller 151. As a result, the visible image formed on the intermediate transfer body 152 is transferred (secondary transfer) onto the sheet P fed in the conveying direction (sub-scanning direction) in synchronization with the image formation.

After the secondary transfer, when the sheet passes through the fixing portion 160, the toner transferred onto the sheet P is heated and melted to be fixed on the sheet P as an image. In the case of duplex printing, the sheet P on the first surface of which an image is formed is conveyed to the reversing portion 200, is switched back, and is introduced again to the transfer unit 140 where an image is formed on the second surface of the sheet P. Thereafter, when the sheet P passes through the fixing unit 160 in the same manner as described above, the toner image on the sheet P is thermally fixed. Then, the sheep P is discharged outside the printer and the printing process is completed.

Various sheets including a widely used plain paper, a recycled paper, a glossy paper, a coated paper, a thin paper, and a thick paper are used in the printer.

Sheet Conveying Apparatus

Next, the configuration of the reversing portion 200 which is the sheet conveying apparatus of this embodiment will be described.

Figure 2:
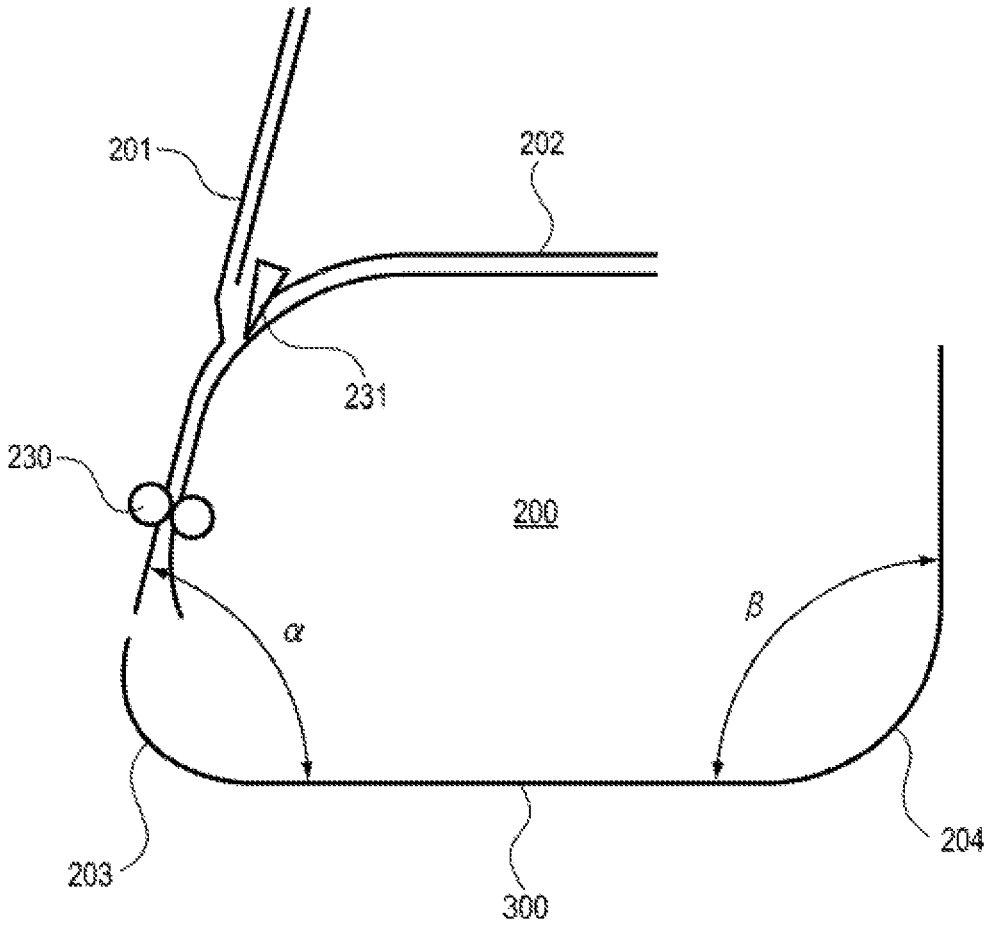
FIG. 2 is a diagram showing a periphery of a reversing portion.
Figure 3A:
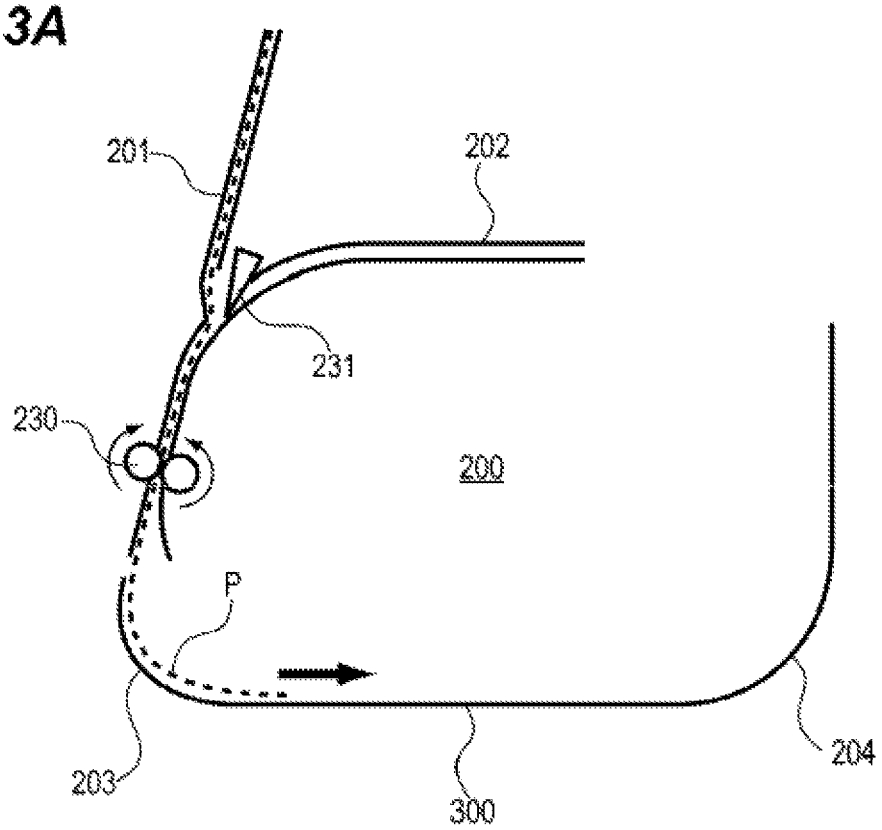
FIGS. 3A and 3B are diagrams showing a movement of a sheet at the reversing portion.
Figure 3B:
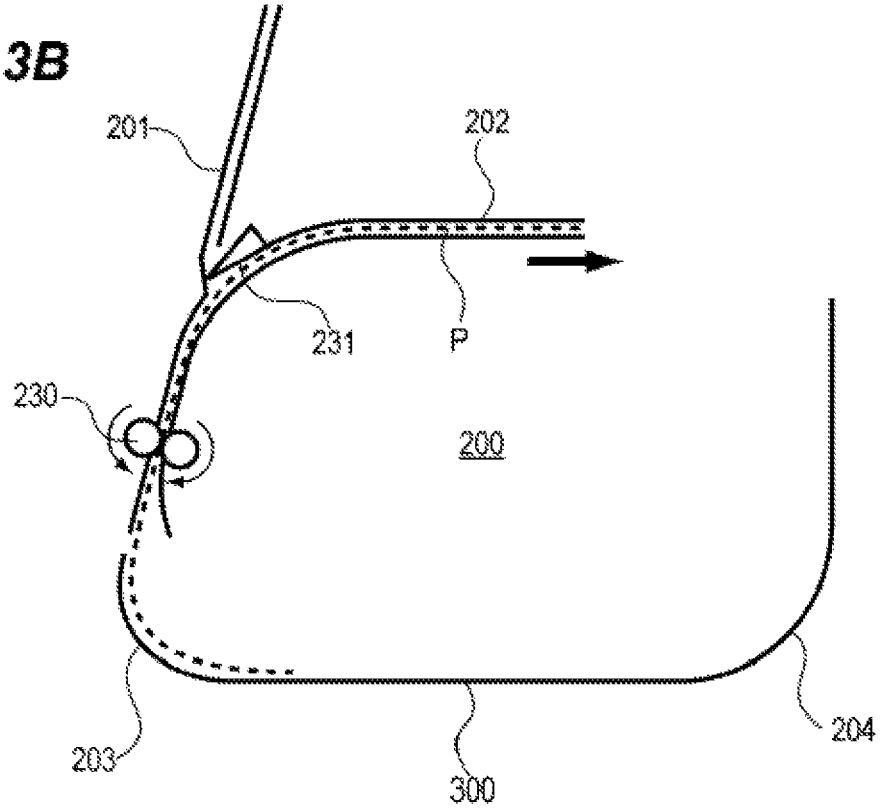

FIG. 2 is a diagram showing a schematic view of the periphery of the reversing portion 200 as viewed from the front of the main body. The upstream conveying path 201 is provided upstream of the reversing section 200 in the sheet conveying direction (hereinafter, simply "upstream"), and the downstream conveying path 202 is provided downstream of the reversing portion 200 in the sheet conveying direction (hereinafter simply "downstream"). The sheet P is conveyed from the upstream conveying path 201 to the reversing portion 200 and is temporarily stopped at the reversing portion 200. Thereafter, the sheet P is switched back and is conveyed to the downstream conveying path 202. For switching the conveying paths, the path switching member 231 which is rotatable is used. The reversing roller 230 serving as a conveying member is provided at a position where the upstream conveying path 201 and the downstream conveying path 202*c* join upstream of the reversing portion 200. The reversing roller 230 is a conveying roller capable of rotating forwardly and reversely. The reversing roller 230 rotates in one direction when conveying the nipped sheet P from the upstream conveying path 201 to the reversing portion 200, and rotates in the reverse direction (the other direction) when conveying the nipped sheet P from the reversing portion 200 to the downstream conveying path 202. Accordingly, after the sheet P is conveyed from the upstream conveying path 201 to the reversing portion 200 as shown in FIG. 3A, the conveying direction is changed to the opposite direction and he sheet P is conveyed from the reversing portion 200 to the downstream conveying path 202 as shown in FIG. 3B. As a result, when the sheet on which an image is recorded on the first surface is reversed and the sheet is conveyed to the transfer portion 140 again, an image is recorded on the second surface.

Curved Portion

The reversing portion 200 is provided with a plurality of curved portions which serve as changing portions for changing the conveying direction by curving the sheet conveyed downstream of the reversing roller 230. In the present embodiment, two curved portions are provided. Namely, the first curved portion 203 is provided at a position close to the reversing roller 230 and the second curved portion 204 is provided at a position distant from the reversing roller 230. By thus providing a plurality of curved portions, the sheet conveyed to the reversing portion 200 is curved in a substantially C shape. Therefore, even, if the sheet size is increased, it is possible to perform switchback conveyance without increasing the size of the apparatus.

Next, each curved portion will foe specifically explained. At each curved portion, the guide member 300 for guiding the sheep P is curved. As a result, the sheep P is conveyed while the conveying direction of the sheet P is changed when the sheep P is curved by the guidance of the guide member 300. The first curved portion 203 is provided on a substantially extended line in the discharge direction of the sheet P discharged from the reversing roller 230 to the reversing portion 200. In the present embodiment, the angle $\alpha$ (see FIG. 2) formed between the direction of the sheet P conveyed downward substantially in the vertical direction from the reversing roller 230 and the direction of the sheet P when leaving the first curved portion 203 is in the ranger of 40° to 80°.

The conveying direction of the sheet P from the first curved portion 203 is substantially horizontal, and the second curved portion 204 is provided on the extended line in this direction. The direction of the sheet P which enters the second curved portion 204 is substantially horizontals. The angle $\beta$ (see FIG. 2) formed between the direction in which the sheet P enters the second curved portion 204 and the direction in which the sheet P is discharged from the second curved portion 204 is in the range of 80° to 100°. Then, the sheet P discharged from the second curved portion 204 is conveyed upward substantially in the vertical direction.

Guide Member

The guide member 300 constituting the reversing portion 200 is provided only outside the reversing portion 200 and is not provided inside the reversing portion 200. That is, the sheet conveying path of the reversing portion 200 from the reversing roller 230 to the second curved portion 204 is constituted by the guide member 300 for guiding one surface of the conveyed sheet. This is because in the case of providing the guide member inside the reversing portion 200, when the sheet P moves from the reversing portion 200 to the downstream conveying path 202 as shown in FIG. 3B, there are concerns that the sheet P is rubbed against the inner guide member, thereby increasing the conveying resistance that the sheet P receives from the guide member increases, and that rubbing marks may remain on the sheet, resulting in an image failure. By arranging the guide member 300 so as only to guide one surface of the conveyed sheet as in this embodiment, the above-described concerns can be eliminated.

Sheet Conveying Speed at Reversing Portion

Next, conveying operations in which the sheet P is conveyed from the fixing device 160 to the reversing portion 200 and the sheet P is discharged from the reversing unit 200 will be described.

Figure 4:
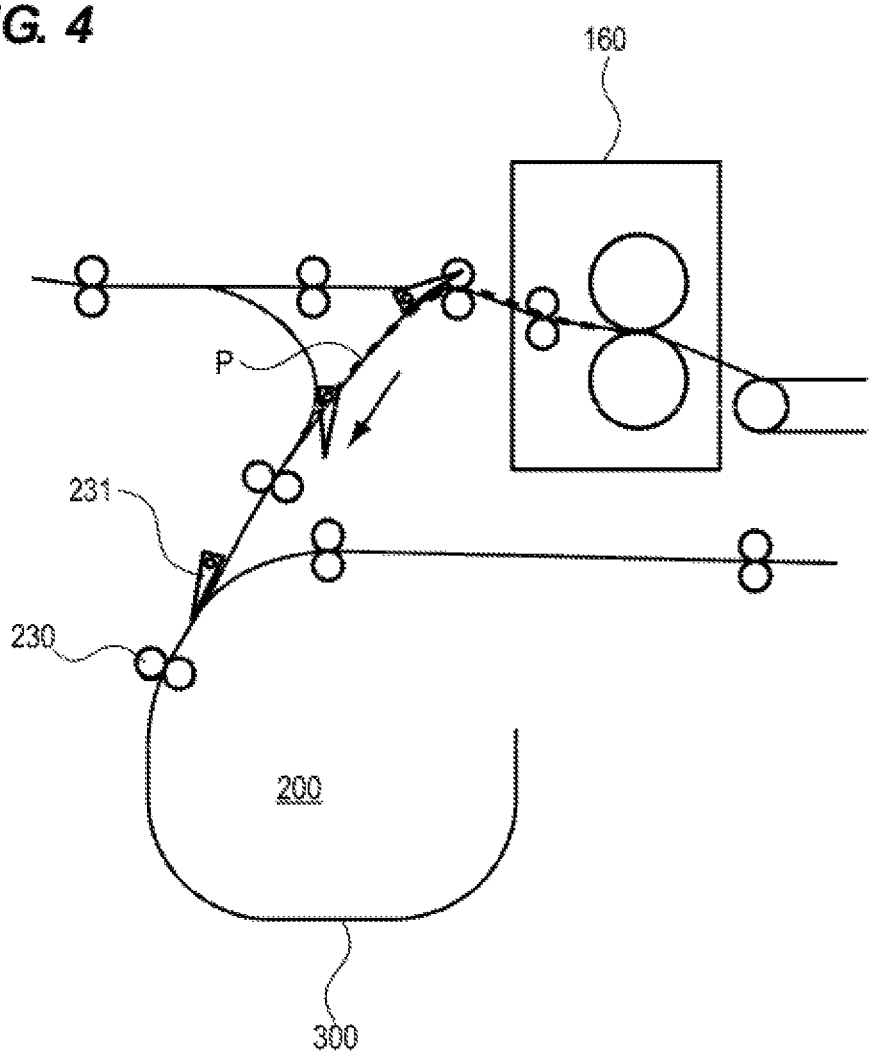
FIG. 4 is a diagram showing an accelerated movement of the sheet.

FIG. 4 is a diagram showing the movement of the sheet P when the sheet P passes through the fixing device 160. The sheet P to which the toner image has been transferred by the transfer portion 140 is conveyed through the fixing device 160 at a speed of 400 to 500 mm/s during which time the sheep P is heated and pressurized to fix the toner image on the sheet P. In the case of duplex printing, the sheet is conveyed from the fixing device 160 to the reversing portion 200. At this time, the conveying speed is changed depending on whether the length of the sheet is equal to or longer than a predetermined length.

Here, whether the length of the sheet is equal to or longer than the predetermined length is determined by whether or not the leading end of the sheet fed by the reversing roller 230 passes through the second curved portion 204. In the present embodiment, when the length in the conveying direction of the sheet 2 is 500 mm or more, the leading edge of the sheet fed by the reversing roller 230 passes through the second curved portion, and when the length is less than 500 mm, before the leading edge of the sheet fed by the reversing roller 230 reaches the second curved portion, the sheep P is switched back and is conveyed to the downstream conveying path 202. Therefore, in the present embodiment, the conveying speed is changed depending on whether the length of the sheet in the conveying direction is 500 mm or more as the predetermined length.

Specifically, in the case of a sheet whose length in the conveying direction of the sheet P is less than 500 mm, after passing through the fixing device 160, the sheet is accelerated to a speed of 1200 mm/s to 1500 mm/s at which speed the sheet is conveyed.

The accelerated sheet P is conveyed by the reversing roller 230 with the accelerated speed being maintained and the leading end of the sheet P enters the first curved portion 203 in the reversing portion 200. The sheet P stops before the leading end of the sheet reaches the second curved portion 204. Thereafter, the stopped sheet P is conveyed to the downstream conveying path at a speed of 600 to 800 mm/s.

As described above, by accelerating the sheet P after passing through the fixing device 160, it is possible to shorten the time required from the transfer of the toner image to the first surface of the sheet P to the transfer of the toner image to the second surface of the sheet P. As a result, productivity of products output from the main body can be increased. However, if the sheet is accelerated when the sheet is in the fixing device 160, the amount of heat given to the sheet P from the fixing unit 160 will change within the surface of the sheet P, resulting in image failure caused by the fixing device. Therefore, it is necessary to perform the acceleration operation of the sheet P after the trailing end of the sheet P passes through the fixing device 160.

Figure 5:
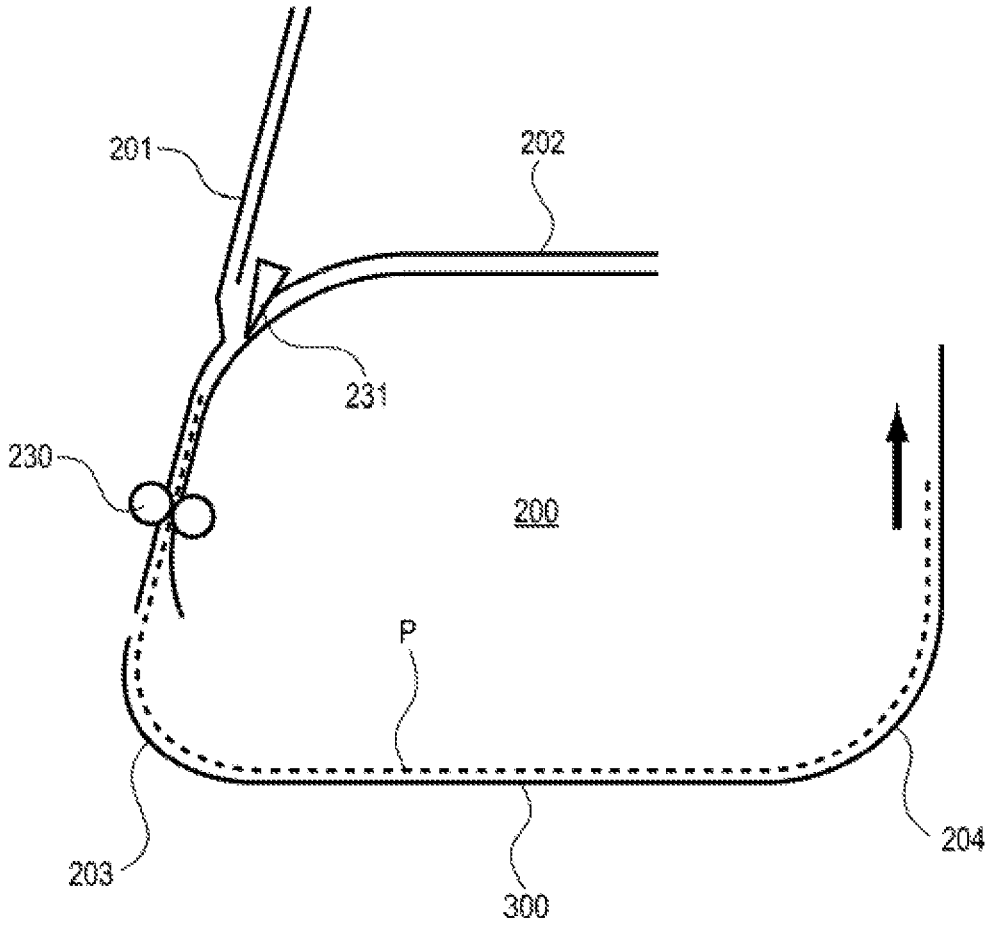
FIG. 5 is a diagram showing a sheet conveyed in a reversing portion.

On the other hand, in the case of a long sheet whose length in the conveying direction is 500 mm or more, when the sheet P is switched back at the reversing portion 200, the leading end of the sheet P reaches the second curved portion 204 and the leading end of the sheet P moves upward along the guide member in the vertical direction downstream of the second curved portion 204 as shown in FIG. 5. In the case where the sheet is conveyed while being curved by the plurality of curved portions as described above, the following problems may occur.

The first problem is an increase in the conveying resistance which occurs when the stiffness of the sheet P is high.

When a sheet with high stiffness passes across the first curved portion 203 and the second curved portion 204, the resistance the sheet P receives from the guide member 300 also increases. This is because the area of the sheet contacting the guide member 300 is also large when the length of the sheet is large. In particular, in the present embodiment, when the sheet P passes through the second curved portion 204, the sheet P runs upward in the vertical direction while colliding with the second curved portion 204 and the guide member 300 downstream of the second curved portion 204. Therefore, the resistance the sheet P receives from the guide member 300 transiently increases.

Figure 6A:
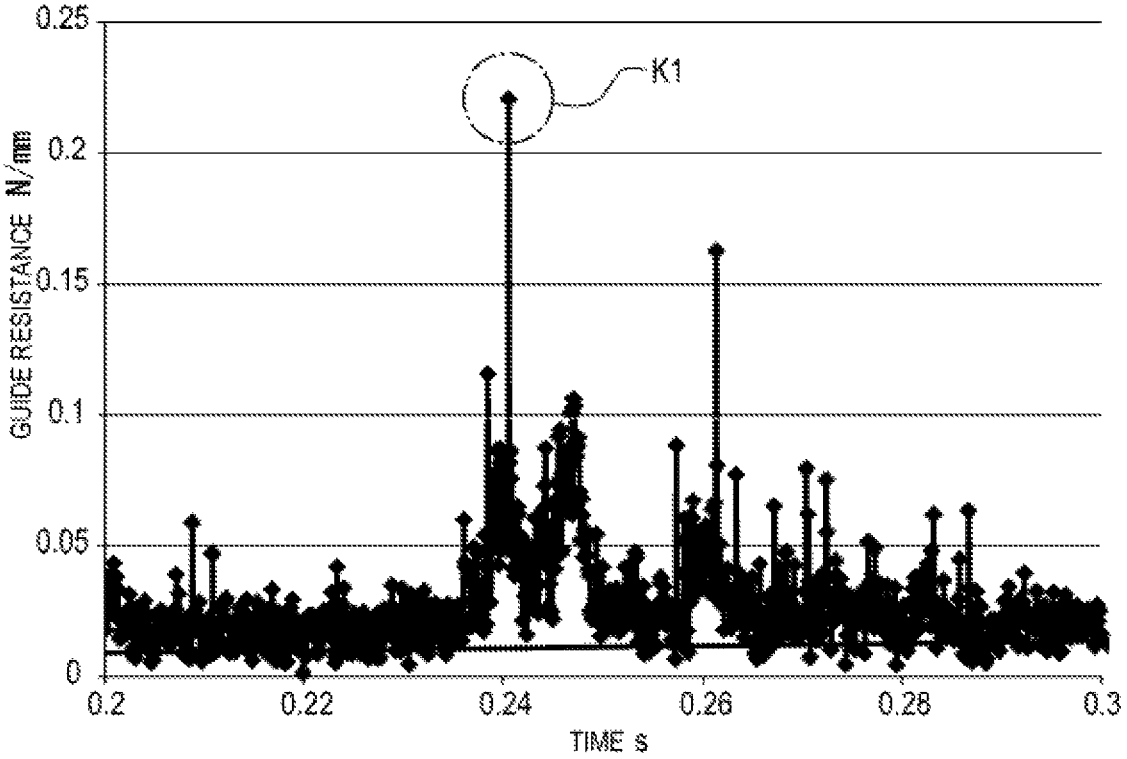
FIGS. 6A and 6B are graphs showing a change in guide resistance.

FIG. 6A is a graph showing the resistance the sheet P receives from the guide member 300 when the sheet P passes through the reversing portion 200. The horizontal axis of the graph indicates the time elapsed since the sheet P has been discharged from the reversing roller 230 and the vertical axis of the graph indicates the force of the resistance the sheet P receives from the guide member 300 at each time. The unit of the vertical axis is (N/mm), which represents the resistance force per 1 mm of the sheet P with respect to the front-back direction of the image forming apparatus main body, that is, the sheet width direction orthogonal to the sheet conveying direction. K1 in FIG. 6A shows the resistance the sheet P receives from the guide member 300 at the moment when the leading end of the sheet P collides with the second curved portion 204. It is confirmed that the resistance the sheet P receives from the guide member 300 increases at the moment of collision of the leading end of the sheet P with the second curved portion 204.

When the resistance the guide member 300 receives from the sheet P increases, the defects occur, which include a defect that the drive source (not shown) which drives the reversing roller 230 is out of step and stops, a defect that slipping occurs between the reversing roller 230 and the sheet P so that the sheets are not conveyed as expected, leading to poor conveyance, and a defect that the sheet P is skewed.

The second problem is that the leading edge of the sheet P buckles when the stiffness of the sheet P is low.

Figure 7:
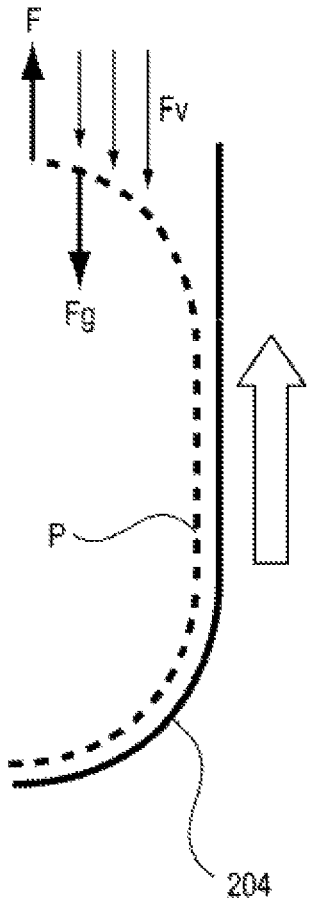
FIG. 7 is a diagram showing a mechanism of buckling.

FIG. 7 is a diagram showing the mechanism of buckling of the sheet P. This problem occurs when the following expression is satisfied, with the air resistance the leading end of the sheet shown in FIG. 7 receives being given as Fv, with the force due to the gravity of the sheet itself being given as Fg, and with the force to keep the shape with the stiffness of the sheet being given as F.

$$Fv+Fg>F \quad (1)$$

In the present embodiment, as shown in FIG. 5, while the sheet conveying direction of the reversing roller 230 is a substantially vertically downward direction, the traveling direction of the leading end of the sheet P passing through the second curved portion 204 is a substantially vertically upward direction. As described above, in the case where the conveying direction of the sheet which has passed through the reversing roller 230 and the conveying direction of the sheet which has passed through the curved portion are set to substantially opposite directions, or in the case where the leading end of the sheet is far from the reversing roller 230, buckling of the sheet is easy to occur. This is because the shape of the sheet near the reversing roller 230 can be regulated by the roller nip, but the shape of the sheet at a position far from the roller nip cannot be regulated by the roller nip. In particular, in the present embodiment, the reversing roller 230 feeds the sheet P with the leading end of the sheet P facing downward in the substantially vertical direction, whereas the sheet which has passed through the second curved portion 204 distant from the reversing roller 230 is conveyed upward in the substantially vertical direction. Therefore, the leading end portion of the sheet is not affected by the roller nip of the reversing roller 230, and the shape of the leading end of the sheet is maintained by the stiffness of the sheet itself.

When the stiffness of the sheet P is low, the force F for maintaining the shape of the sheet P with the stiffness is small, so that the shape of the leading end of the sheet P tends to be influenced by the air resistance Fv and its own gravity Fg. As a result, the leading edge of the sheet is likely to buckle. In addition, when the leading end of the sheet P is conveyed vertically upward at a position higher than the bottom surface of the reversing portion 200 by 60 mm or more, the force Fg due to the gravity of the sheet P itself also increases, so that buckling is likely to occur.

Dealing with the problems of an increase in conveying resistance and easiness of buckling, in the present embodiment, the control portion 103 controls the speed of a reversing motor (not shown) which drives the reversing roller 230 according to the sheet size in order to suppress the occurrence of the above problems. Specifically, the control unit 103 controls the conveying speed such that V1<V2 where V1 denotes the conveying speed of such a long sheet that the leading end of the sheet conveyed by the reversing roller 230 passes through the second curved portion 204 and V2 denotes the conveying speed of such a short sheet that the sheet is switched back without reaching the second curved portion 204. The control portion 103 a processor and a memory. The memory stores instructions which, when executed by the processor, cause the image forming apparatus to perform the operation shown in the flowchart of FIG. 8.

Figure 8:
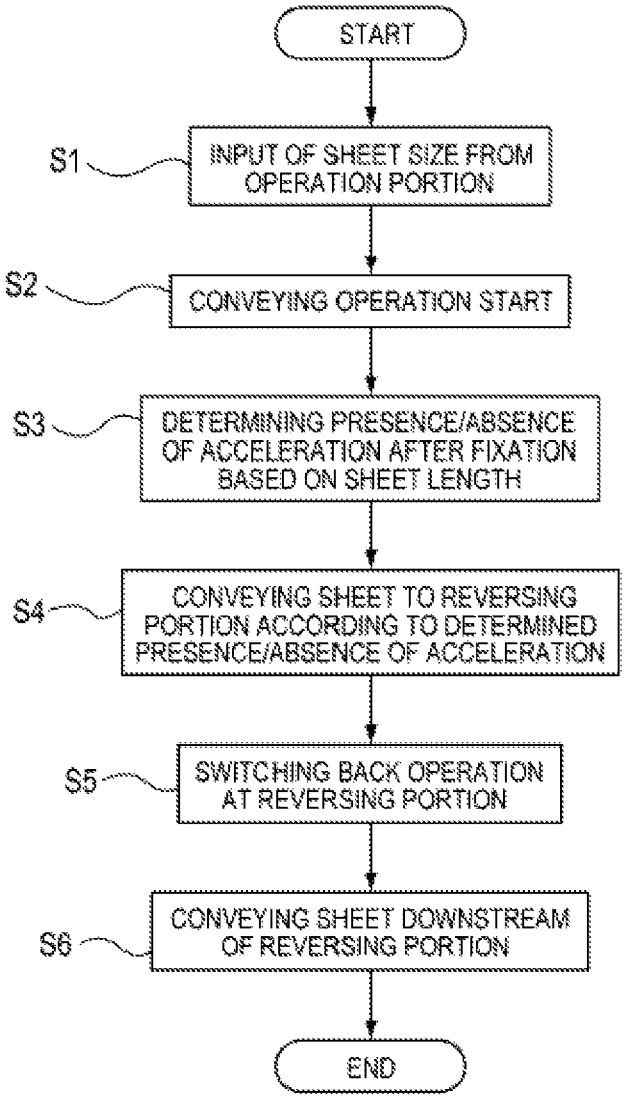
FIG. 8 is a flowchart showing conveying operations.

That is, as shown in the flowchart of FIG. 8, when a sheet size is input from the operation portion 310 (see FIG. 1) (step S1) and the image forming operation is started, the sheet conveying operation is started (step S2). Then, a toner image is transferred on the first surface and the sheet P passes through the fixing device 160. In the case of duplex printing, the sheet P is conveyed to the reversing portion 200 after the image is fixed. At this time, the sheet conveying speed is determined based on the sheet size (step S3). After that, the sheet is conveyed at the reversing portion 200 at the determined speed (step S4).

In the present embodiment, in the case of a long sheet having a length in the conveying direction of 500 mm or more, after the sheet P has passed through the fixing device 160 at a conveying speed of 400 mm to 500 mm at the time of fixing, the sheet P is not accelerated, which is different from the case of the sheet P having a length in the conveying direction of less than 500 mm. Namely, the leading end of the sheet P enters the reversing portion 200 while maintaining conveying speed of 400 mm to 500 mm and the sheet P is conveyed downstream of the first curved portion 203 and the second curved portion 204. Thereafter, the sheet P is switched back (step 35) and is conveyed, to the downstream conveying path at a speed of 600 mm/s to 800 mm/s (step 36).

In this way, when the sheet P is conveyed to the reversing portion 200, the conveying speed V1 of the sheet P with a length of 500 mm or more in the conveying direction is less than the conveying speed V2 or the sheet P with a length less than 500 mm in the conveying direction (V1<V2). As a result, even if the sheet has high stiffness as described above, it is possible to prevent two problems including an increase in conveying resistance and buckling of thin paper.

That is, with respect to the problem of an increase in the conveying resistance of the sheet with high stiffness, by prolonging the time during which the leading edge of the sheet P collides with the second curved portion 204 and runs upward, the shock occurred when the sheet P collides with the second curved portion 204 can be relieved.

Figure 6B:
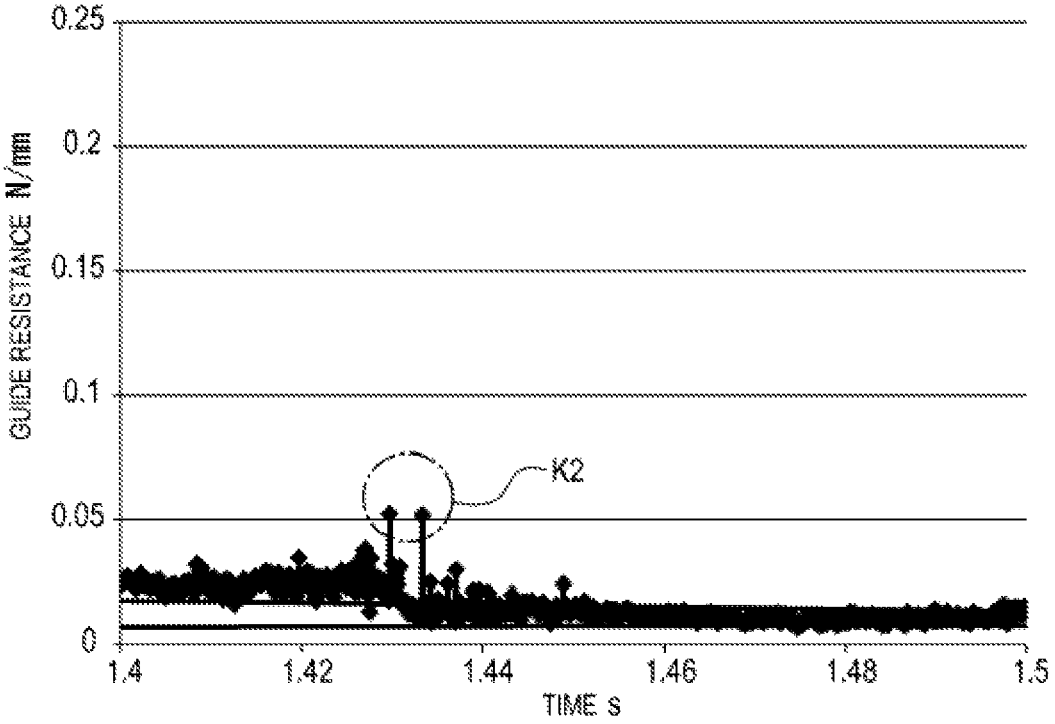

FIG. 6B is a graph showing the torque in the case where the sheet P passes through the second curved portion 204 at the speed of 470 mm/s. The horizontal axis of the graph indicates the time elapsed since the sheet has been discharged from the reversing roller 230 and the vertical axis of the graph indicates the force of the resistance the sheet P receives from the guide member at each time.

At K2 in FIG. 6B, the sheet P collides with the second curved portion 204, but the increase in the transient resistance that has existed at K1 in FIG. 6A disappears at K2 in FIG. 6B. By lowering the conveying speed of the sheet P when passing through the second curved portion as described above, the resistance the sheet P receives from the guide member 300 can be reduced.

Further, it is possible to prevent the problem of buckling of a sheet with low stiffness by lowering the conveying speed at the second curved part 204 and the guide member 300 which is located downstream of the second curved part 204.

As shown in the above equation (1), buckling occurs when the sum of the air resistance Fv and the gravity Fg of the sheet itself is greater than the force F for keeping its shape with the stiffness of the sheet.

It is known that the air resistance Fv is expressed by the following equation when the conveying speed is given as v (k is a constant).

$$Fv=k\times v \quad (2)$$

Therefore, by decreasing the conveying speed v, the air resistance Fv is decreased. As a result, the expression (1) is not satisfied so that buckling of the sheet can be prevented. FIG. 9 is a table showing sheet conveying speeds and presence/absence of buckling in the reversing portion 200. According to this table, it can be seen that buckling of the sheet can be prevented by setting the sheet conveying speed to 600 mm/s or less in the reversing portion 200.

Incidentally, as described above, the guide member 300 is arranged only on the outside of the reversing portion 200 in the present embodiment. It would also be considered to provide a guide member inside of the reversing portion 200 to regulate the shape of the leading end of the sheet P (prevent buckling) between the outside guide member and the inside guide member. However, in the present embodiment, it is possible to sufficiently prevent buckling by reducing the sheet conveying speed v. As a result, it is unnecessary to provide such an inner guide member.

As described above, by changing the conveying speed of the sheet P according to the length of the sheet, problems including an increase in conveying force of a sheet with high stiffness occurring when the length of the sheet P is large and buckling of a sheet with low stiffness can be prevented.

A Plurality of Curved Portions

In the present embodiment, as described above, the two curved portions including the first curved portion 203 and the second curved portion 204 are provided in the reversing portion 200. However, three or more curved portions may be disposed in the reversing portion 200 so that the sheet is curved and conveyed by the three or more curved portions.

Figure 10:
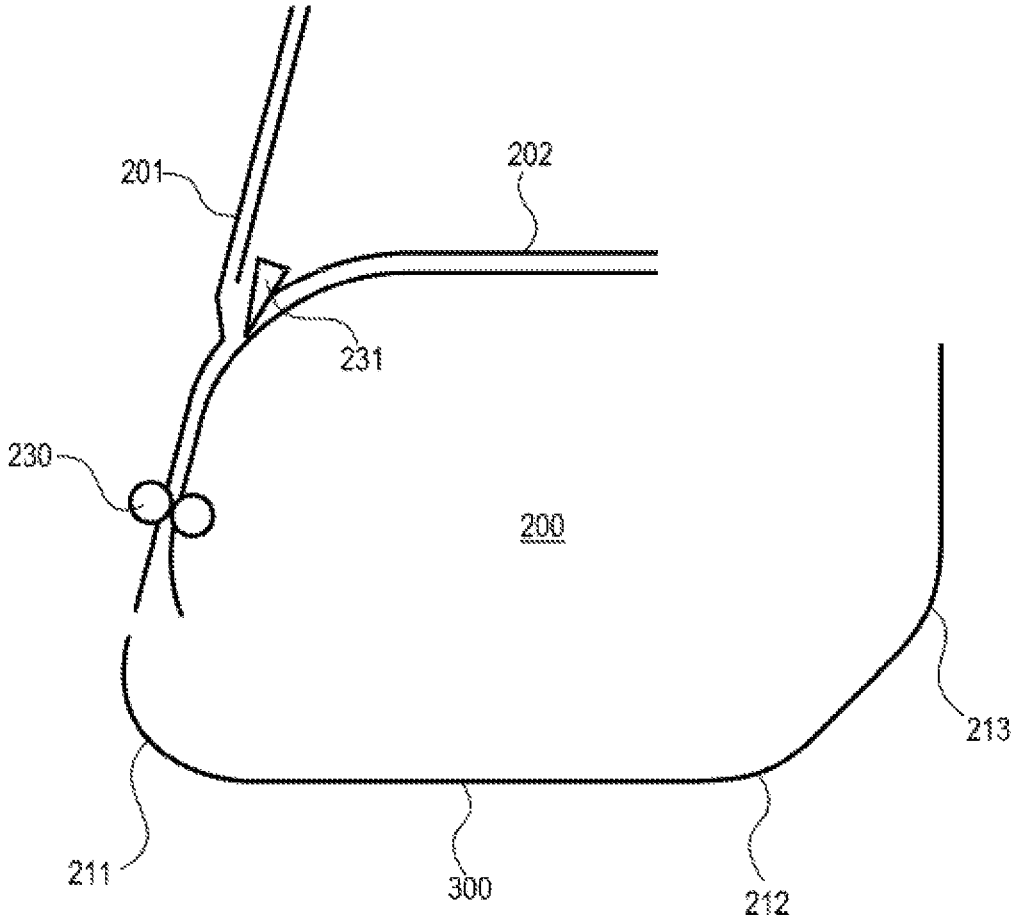
FIG. 10 is a diagram showing a configuration of a reversing portion which has three curved portions.

For example, as shown in FIG. 10, the third curved portion 213 can be provided downstream of the first curved portion 211 and the second curved portion 212. With this configuration, the sheet conveyed by the reversing portion 200 gently gets curved, which enables the sheet P to be conveyed more smoothly. In the above-described embodiment, it is determined whether the conveying speed of the sheet is changed or not based on whether the leading end of the sheet to be reversed passes through the second curved portion 204 or not. Namely, the second curved portion from the reversing roller 230 is used as a specific curved portion serving as the reference for changing the conveying speed of the sheet. However, the third curved portion 213 which is the third curved portion from the reversing roller 230 can also be used as the specific curved portion serving as the reference for changing the sheet conveying speed.

That is, in the case of a sheet having high stiffness, when the sheet is conveyed downstream of the specific curved portion serving as the reference for changing the sheet conveying speed, the conveying resistance with the guide member 300 becomes high, which may cause conveying failure. Further, in the case of a sheet having low stiffness, when the buckling is likely to occur, the curved portion is selected as a specific curved portion. When the sheet conveyed to the reversing portion 200 in the conveying direction has such a length in the sheet conveying direction that the sheet is conveyed downstream of the specific curved portion, the conveying speed is lowered than that of the sheet which is not conveyed to the specific curved portion. As a result, the sheet can be conveyed without causing sheet conveying failure in the reversing portion,

Second Embodiment

Figure 11:
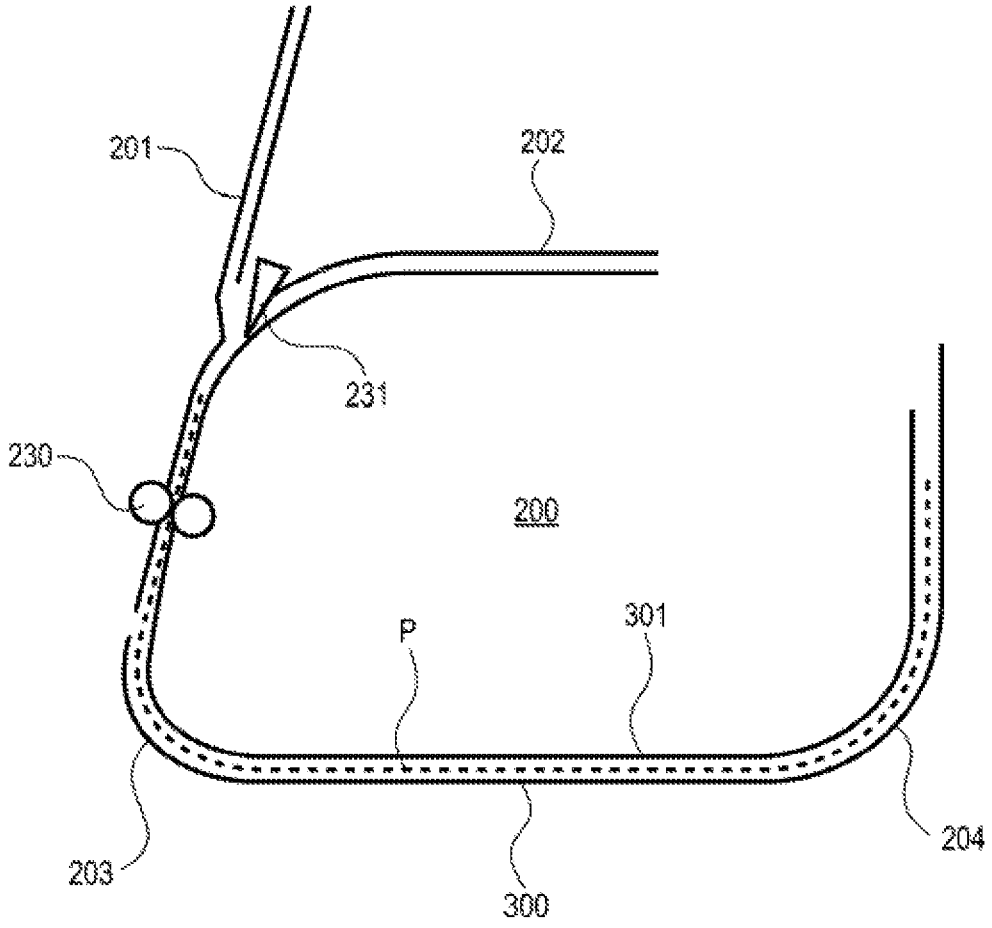
FIG. 11 is a diagram showing the configuration of a reversing portion with guide members for guiding the outer side and the inner side of a conveyed sheet.

In the above-described first embodiment, the guide member 300 for guiding the sheet conveyed through the reversing portion 200 has the configuration in which one surface (outer side) of the sheet is guided. However, as shown in FIG. 11, as a guide member for guiding the sheet conveyed through the reversing portion 200, in addition to the guide member 300 for guiding the outside of the sheet, the guide member 301 for guiding the inside of the sheet can be provided.

By providing the guide member 301 on the inside, there is a concern that the resistance the sheet P receives from the guide member 301 increases when the sheet P is switched back and moves from the reversing portion 200 to the downstream conveying path 202. However, since the shape of the leading end of the sheet P can be regulated to some extent by the inner guide member 301, buckling of a sheet with low stiffness is less likely to occur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-085129, filed Apr. 24, 2017, which is hereby incorporated by reference herein in its entirety.

What is claimed is:

1. A sheet conveying apparatus, the sheet conveying apparatus comprising:

a conveying member configured to convey a sheet;

a first changing portion configured to change a conveying direction of the sheet conveyed by the conveying member by curving the sheet;

a second changing portion configured to change the conveying direction of the sheet, which has been changed in conveying direction by the first changing portion, by curving the sheet; and a control portion configured to control a conveying speed of the sheet, wherein the conveying member conveys the sheet so that a leading edge of the sheet moves to the first changing portion by rotating in a first direction, and the conveying direction of the sheet being conveyed by the conveying member rotating in the first direction is changed by the first changing portion, wherein the conveying direction of the sheet, which has been changed by the first changing portion, is changed by the second changing portion, with the sheet being conveyed by the conveying member rotating in the first direction, wherein the conveying member conveys the sheet by rotating in a second rotating direction opposite to the first direction after rotating in the first direction, and wherein the control portion controls a conveying speed of the sheet such that (i) in a case of conveying a first sheet, a conveying speed V1 is set as the conveying speed of the first sheet on the conveying member rotating in the first direction at least when a leading edge of the first sheet contacts the second changing portion, and (ii) in a case of conveying a second sheet that is shorter than the first sheet, a conveying speed V2 that is faster than the conveying speed V1 is set as the conveying speed of second sheet on the conveying member rotating in the first direction at least when a leading edge of the second sheet contacts the first changing portion, and the second sheet does not reach the second changing portion when the second sheet is conveyed by the conveying member rotating in the first direction.

2. The sheet conveying apparatus according to claim 1, wherein the controller sets the conveying speed of the first sheet on the conveying member rotating in the first direction to the conveying speed V1 when the leading edge of the first sheet conveyed by the conveying member rotating in the first direction contacts the first changing portion and the leading edge of the first sheet conveyed by the conveying member rotating in the first direction contacts the second changing portion.

3. The sheet conveying apparatus according to claim 1, wherein the controller sets the conveying speed of the sheet on the conveying member rotating in the first direction to a conveying speed V3, which is faster than the conveying speed V1, when the first sheet is conveyed by the conveying member rotating in the second direction and the second sheet is conveyed by the conveying member rotating in the second direction.

4. The sheet conveying apparatus according to claim 1, wherein whether or not a sheet is to reach the second changing portion is determined by the controller based on a length of the sheet in the conveying direction of the sheet.

5. The sheet conveying apparatus according to claim 1, wherein a heading direction of the leading edge of the sheet from the conveying member to the first changing portion and a heading direction of the leading edge of the sheet that has been changed by the second changing portion are substantially opposite to each other.

6. The sheet conveying apparatus according to claim 1, wherein the second changing portion changes to a conveying direction of a sheet that is a substantially vertically upward direction.

7. The sheet conveying apparatus according to claim 1, wherein the first changing portion includes a guide member for guiding a sheet and the second changing portion includes another guide member for guiding a sheet.

8. The sheet conveying apparatus according to claim 1, wherein a sheet conveying path from the conveying member to the second changing portion includes a guide member for guiding one surface of a conveyed sheet.

9. The sheet conveying apparatus according to claim 1, wherein the controller sets the conveying speed to the speed V1 from when the leading edge of the first sheet contacts the second changing portion until when the first sheet stops in a case that the first sheet is conveyed by the conveying member rotating in the first direction.

10. A sheet conveying apparatus comprising:

a conveying roller configured to convey a sheet;

a control portion configured to control the conveying roller;

a first curved portion configured to curve the sheet conveyed by the conveying roller by contacting the sheet, and a second curved portion disposed at different position from the first curved portion and configured to curve the sheet by contacting the sheet that has been curved by the first curved portion, wherein the conveying roller is configured to convey the sheet so that a leading edge of the sheet is conveyed toward the first curved portion by rotation of the conveying roller in one direction and thereafter to switch back and convey the sheet by rotation of the conveying roller in another direction, wherein the control portion controls the conveying roller such that when a first sheet is conveyed, the first sheet is conveyed at a first speed by rotation of the conveying roller in the one direction, and when a second sheet whose length in a conveying direction is less than that of the first sheet is conveyed, the second sheet is conveyed at a second speed that is greater than the first speed by rotation of the conveying roller in the one direction, wherein the first sheet reaches the first curved portion and the second curved portion when the first sheet is conveyed by the conveying roller in the one direction, and wherein the second sheet reaches the first curved portion and does not reach the second curved portion in a case that the second sheet is conveyed by the conveying roller rotating in the one direction.

11. The sheet conveying apparatus according to claim 10, wherein the conveying roller is configured to convey a sheet downward, wherein the first curved portion is configured to curve the sheet conveyed by the conveying roller such that a leading edge of the sheet is directed in a substantially horizontal direction, and wherein the second curved portion is configured to curve the sheet conveyed by the conveying roller such that the leading edge of the sheet is directed in an upward direction.

12. The sheet conveying apparatus according to claim 10, wherein the second curved portion is configured to curve a sheet conveyed by rotation of the conveying roller in the one direction such that a direction of a leading edge of the sheet is changed from a substantially horizontal direction to a substantially vertical upward direction.

13. The sheet conveying apparatus according to claim 10, wherein a leading edge of a sheet curved by the second curved portion is directed to a substantially vertical upward direction.

14. An image forming apparatus comprising:

an image forming portion configured to form an image on a sheet;

a conveying member configured to convey the sheet;

a first changing portion configured to change a conveying direction of the sheet conveyed by the conveying member by curving the sheet;

a second changing portion configured to change the conveying direction of the sheet, which has been changed in conveying direction by the first changing portion, by curving the sheet; and a control portion configured to control a conveying speed of the sheet, wherein the conveying member conveys the sheet so that a leading edge of the sheet moves to the first changing portion by rotating in a first direction, and the conveying direction of the sheet being conveyed by the conveying member rotating in the first direction is changed by the first changing portion, wherein the conveying direction of the sheet, which has been changed by the first changing portion, is changed by the second changing portion, with the sheet being conveyed by the conveying member rotating in the first direction, wherein the conveying member conveys the sheet by rotating in a second rotating direction opposite to the first direction after rotating in the first direction, and wherein the control portion controls a conveying speed of the sheet such that (i) in a case of conveying a first sheet, a conveying speed V1 is set as the conveying speed of the first sheet on the conveying member rotating in the first direction at least when a leading edge of the first sheet contacts the second changing portion, and (ii) in a case of conveying a second sheet that is shorter than the first sheet, a conveying speed V2 that is faster than the conveying speed V1 is set as the conveying speed of the second sheet on the conveying member rotating in the first direction at least when a leading edge of the second sheet contacts the first changing portion, and the second sheet does not reach the second changing portion when the second sheet is conveyed by the conveying member rotating in the first direction.

* * * * *